United States Patent [19]

Hanser

[11] Patent Number: 4,741,665

[45] Date of Patent: May 3, 1988

[54] GUIDE VANE RING FOR TURBO-ENGINES, ESPECIALLY GAS TURBINES

[75] Inventor: Hagen Hanser, Munich, Fed. Rep. of Germany

[73] Assignee: MTU Motoren- und Turbinen-Union Muenchen GmbH, Munich, Fed. Rep. of Germany

[21] Appl. No.: 929,624

[22] Filed: Nov. 12, 1986

[30] Foreign Application Priority Data

Nov. 14, 1985 [DE] Fed. Rep. of Germany ..... 3540401

[51] Int. Cl.[4] ..... F01D 1/30

[52] U.S. Cl. ..... 415/150; 415/159; 415/160; 415/161; 415/156

[58] Field of Search ..... 415/150, 159, 161, 160, 415/156

[56] References Cited

U.S. PATENT DOCUMENTS

| | | | |
|---|---|---|---|
| 3,237,918 | 3/1966 | Le Bell et al. . | |
| 4,664,594 | 5/1987 | Mandet | 415/150 |

FOREIGN PATENT DOCUMENTS

| | | | |
|---|---|---|---|
| 223946 | 3/1958 | Australia | 415/156 |
| 1041739 | 10/1958 | Fed. Rep. of Germany . | |
| 93903 | 6/1983 | Japan . | |
| 611726 | 9/1945 | United Kingdom | 415/156 |
| 1023766 | 3/1966 | United Kingdom . | |

*Primary Examiner*—Robert E. Garrett
*Assistant Examiner*—Therese Newholm
*Attorney, Agent, or Firm*—W. G. Fasse; D. H. Kane, Jr.

[57] ABSTRACT

A guide vane for turbo-engines has a stationary vane section and a movable vane section with a gap between the two sections. The gap is covered on one side by a flexible band connected along its tape edges to the vane sections. The other side of the gap is covered by an elastic connected to the stationary vane section along one band edge while the other band edge overlaps part of the movable vane section to permit free relative movement between the elastic band (7) and the movable vane section. A plurality of such guide vanes are mounted at the radially outer end of their position adjustment member to an outer housing ring while the radially inner vane end or at least the radially inner end of the movable vane is free. A common position adjustment ring is connected to all adjustment members.

13 Claims, 3 Drawing Sheets

GUIDE VANE RING FOR TURBO-ENGINES, ESPECIALLY GAS TURBINES

FIELD OF THE INVENTION

The invention relates to a guide vane and guide vane rings for turbo-engines, such as gas turbines. The vane ring or so-called bucket ring is located in a channel formed between two concentric rings of the turbo-engine housing.

DESCRIPTION OF THE PRIOR ART

German Patent (DE-PS) No. 1,041,739 discloses a guide vane ring or bucket ring in which the individual vanes have a stationary vane section on the inlet side and a position adjustable or movable vane section on the outlet side. The movable vane section is adjustable in its position relative to the stationary vane section. A separation gap between the two vane sections is located in the zone where the vane has its largest vane thickness. Even in the maximally deflected end positions of the movable vane section, there is still a connection between the stationary vane section and the movable vane section, such connection extending in the tangential direction. This type of prior art connection between the movable and stationary vane sections as disclosed in German Pat. No. 1,041,739 requires a pivoting mounting for the adjustment of the movable vane section. The pivoting mounting in turn requires hinging axes in the center of the movable vane section and the entire construction is rather heavy, requiring a massive bearing for the support of the movable vane section at its radially outer end and at its radially inner end. The radially outer end is pivotally connected to an outer turbine housing ring while the radially inner end is pivotally connected to an inner turbine housing ring. It is difficult to satisfy the space requirements for such mountings, especially at the radially inner turbine housing ring.

OBJECTS OF THE INVENTION

In view of the foregoing it is the aim of the invention to achieve the following objects singly or in combination:

to provide a new type of guide vane for turbo-engines and the like which is so-constructed that substantial, massive hinging axes are no longer necessary between the stationary vane section and the movable vane section;

to construct a guide vane in such a way that is is sufficient to support it only at one end, preferably at the radially outer end and to avoid any mounting of the movable vane section at its radially inner end;

to construct the tilting shaft for the movable vane section as light as possible and to simplify the connection between the tilting shaft and the movable vane section; and to aerodynamically cover the gap between the stationary vane section and the movable vane section.

SUMMARY OF THE INVENTION

According to the invention the individual guide vanes are so constructed that the gap between the stationary guide vane section is covered on one side by an elastic cover member such as a flexible band while the other side of the gap is covered by an elastic cover member such as an elastic tape. The longitudinal edges of the flexible band are permanently secured to the edges of the guide vane sections adjacent to the gap.

The elastic tape on the other hand is connected permanently only along one of its edges to the stationary vane section while the other edge of the elastic tape is overlapping the respective edge of the movable vane section so that relative movement between the elastic tape and the movable vane section is possible.

The most important advantage of the invention is seen in that with the vanes according to the invention it is now possible to construct a so-called bucket ring which does not require any massive hinging axes for the drive connection between the tiltable or movable vane section and the stationary housing ring and which does not require a bearing mounting at both ends, namely at each concentric housing rings. Rather, a bearing mounting at the radially outer end of the movable vane section is sufficient. Thus, a substantial space saving is achieved at the radially inner end of the movable vane section at the inner housing ring. This space saving provides space which is useful for other purposes such as optimizing the sealing gap between the rotor vanes and the stationary housing component. Such optimal sealing gap control can now be achieved, for example, actively by a cooling air responsive sealing gap control. Other structural features of the inner ring of the turbine housing are now also possible due to the additional space provided by the invention. For example, thermal problems or other sealing problems can now be solved more easily.

Other advantages of the guide vanes according to the invention are seen in that the individual vanes have a relatively simple structure and hence are easily and relatively inexpensively produceable. The maintenance of fluid flow engines equipped according to the invention has also been simplified so that repair work and exchange work can be easily performed. Yet another advantage is seen in that the bridging of the gap between the stationary and tiltable or movable vane section does not cause any aerodynamic disturbance, especially of the wing type cross-sectional profile. The cover members according to the invention bridge the gap independently of the respective instantaneous position of the movable guide vane section relative to the stationary guide vane section. The arrangement and construction of the flexible band provides a relatively high durability against temperature changes. As a result, the operational life of these cover members according to the invention is also substantial. The elastic tape must have characteristics permitting the relative sliding movement between the tape and the movable vane section. For this purpose, the flexible cover band may be stiffer than the elastic cover tsape since the flexible band actually takes the place of the hinging axis of the movable vane section. However, both the elastic covering tape and the elastic covering band can be made of fiber composite materials which have been found to be especially suitable for the present purposes.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
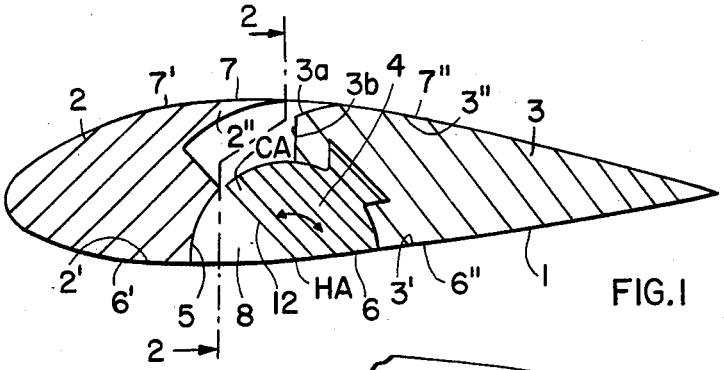
FIG. 1 is a sectional view through a guide vane structure according to the invention, whereby the sectional plane extends perpendicularly to the longitudinal central axis of the guide vane.

The sectional view of FIG. 1 illustrates a guide vane 1 according to the invention. A plurality of such guide vanes are connected to form a guide ring which is, for example, located in an inlet channel of a gas turbine engine. The guide vane 1 has a stationary gas inlet section 2 and a movable outlet section 3. The end of the section 3 points toward a turbine stage with its rotor vanes, not shown.

The guide vane 1 also has a gap 8 between its stationary section 2 and its movable section 3. The gap 8 extends approximately through a zone where the guide vane 1 has its largest thickness. A central axis CA passes longitudinally through the vane 1. The sides of the vane sections forming the gap 8 are contoured as will be described in more detail below with reference to FIG. 4. A position adjustment member 4 is operatively secured to the movable vane section 3 for adjusting the position of the movable vane section 3 relative to the stationary vane section 2 as will also be described in more detail below with reference to FIGS. 4 and 5.

According to the invention the gap 8 is closed at its lower end by a flexible cover member or band 6 having a first edge 6′ permanently secured to a lower rim 2′ of the stationary vane section 2 and a second edge 6″ permanently secured to a lower rim 3′ of the movable vane section 3. The upper end of the gap 8 is also closed according to the invention by an elastic cover member or tape 7 in the form of an elastic tape having an edge 7′ permanently secured to an upper rim 2″ of the stationary vane section 2 and a further edge 7″ overlapping a rim portion 3″ of the movable vane section 3 for permitting the hinging movement of the movable section 3 about its hinging axis HA as indicated by the double arrow in FIG. 1.

An inwardly located portion of the flexible band 6 is also connected to the position adjustment member 4 so that the hinging axis HA is located in the plane defining the contour of the guide vane and in the flexible band 6. Said contour is symetrical to a plane in axis CA. The hinging axis HA and the central axis CA extend in parallel to each other and perpendicularly to the plane of the drawing sheet. This arrangement of the covering flexible band 6 and of the covering elastic tape 7 makes sure that the gap 8 remains covered in any possible position of the vane section 3 relative to the vane section 2.

The flexible cover 6 is preferably made of an elastomeric material such as a synthetic elastomeric material, for example, a silicon rubber. Where engine operating temperatures are to somewhat exceed 200° C., it is suggested to make the flexible cover band 6 of polyimide or similar temperature resistant synthetic materials. It has been found that reinforced synthetic materials, especially elastomeric materials or composite materials of elastomeric materials, or rubber type synthetic materials are suitable for the present purposes because these materials have the desired strength at the occurring operating temperatures and they remain sufficiently elastic for the present purposes. The mentioned composite materials may comprise fiber reinforcing inserts in the form of webbings or fabrics made of carbon fibers, glass fibers, or metal fibers.

Fiber composite materials including synthetic resins, especially polymers of graphite, aramide, or polyamide polymers which may be used in the form of fibers or webbings are suitable for the present purposes. Such webbings may form tapes comprising several strips or layers which in turn may be interconnected, for example by vulcanization.

The cover tape 7 does have to be elastic, but it needs to permit the relative movement of the vane section 3 which will slide relative to the portion 7″. Simple or composite materials may also be used for making the elastic tape 7. The tilting range of the section 3 relative to the section 2 will normally be within about 0° to 45° (see FIG. 5). The elastic tape 7 may, for example, be made of films of fluorinated ethylene propylene resins or polytetrafluoroethylene. Different types of synthetic resins, especially polymeric resins are suitable for the present purposes, including polyimide. It has been found that the flexible band 6 and the elastic tape 7 may also be made of the same material if this is convenient. However, as far as their effectiveness is concerned, different materials may be selected for the particular purposes.

In this context the term "elastic" for the characteristic of the tape 7 means a quality which satisfies Hook's Law which means that it returns by itself into a starting position after it has been brought into another position by an applied external force. On the other hand, the term "flexible" as used herein means a material that is sufficiently pliable and bendable, however, which will not return by itself into a starting position once an external force is released.

Figure 2:
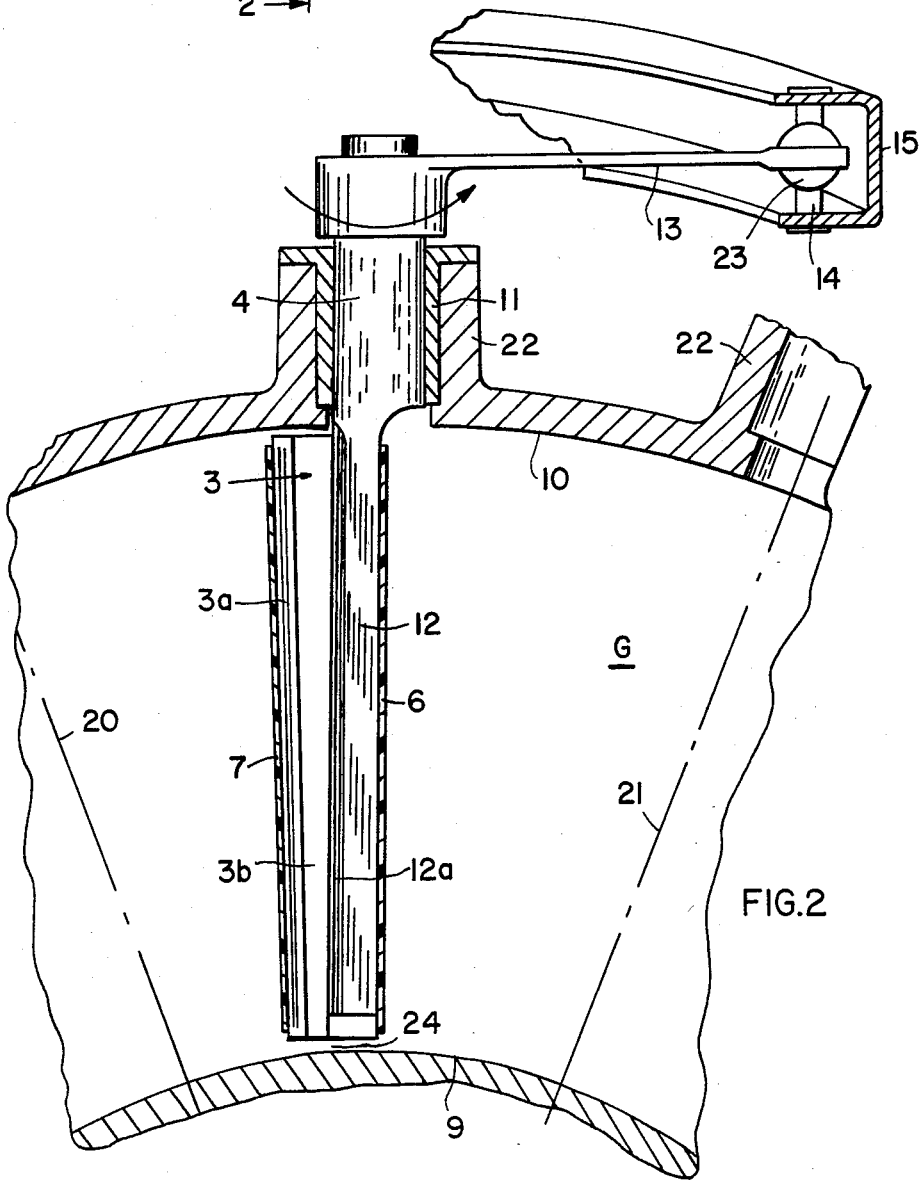
FIG. 2 is a view toward the plane 2—2 as shown in FIG. 1, whereby certain housing components not seen in FIG. 1 are shown in section in FIG. 2.

In FIG. 2 an inner housing ring 9 and an outer housing ring 10 are shown to illustrate the gap G in which a plurality of guide vanes according to the invention are mounted. The viewing direction for FIG. 2 is shown by the plane 2—2 in FIG. 1. Thus, the stationary vane section 2 is not visible in FIG. 2. Only one vane section 3 is visible in FIG. 2. However, the radial axes 20 and 21 indicate that a plurality of such vanes are distributed in the gap G formed by the concentric rings 9 and 10 of the turbine housing. The outer housing ring 10 has mounting sockets 22 distributed around its circumference for holding bearings, such as sleeve bearings 11 in which the upper end of the adjustment member 4 is rotatably held. An adjustment arm 13 is mounted to the upper end of the adjustment member 4 for rotating the vane section 3 relative to the vane section 2. In reality the arm 13 extends into the plane of the drawing sheet behind the upper end of the adjustment member 4. Thus, it would not be readily visible in the illustration of FIG. 2. Therefore, the arm 13 has been rotated by 90° to make it visible. In the normal position of the vane 1 the arm 13 would extend in parallel to the longitudinal rotational axs of the turbine engine to which the rings 9 and 10 are concentric. The outer end of the adjustment arm 13 is connected through a pivot 23 and a pivot bolt 14 to an adjustment ring 15 which is also concentric relative to the longitudinal central axis of the engine. All of the movable guide vane sections 3, 20, 21, and so forth are connected to the adjustment ring 15 as just described. Therefore, rotation of the adjustment ring 15 clockwise or counterclockwise about the longitudinal central axis of the engine, will cause the hinging or tilting of all movable vane sections 3 in unison about the hinging axis HA shown in FIG. 1.

FIG. 2 also shows the flexible band 6 and the elastic tape 7 in section. Additionally, the surface portions 12 and 12*a* of the adjustment member 4 and the surface portions 3*a* and 3*b* of the movable vane section 3 are visible in FIG. 2. It will be noted from FIG. 2 that the movable vane section 3 is mounted or supported only at its upper end with the aid of the bearing 11 while the lower end of the vane section 3 is free, thereby avoiding the use of any space near the ring 9 for any mounting purposes. The gap 24 between the lower end of the section 3 and the ring 9 may be provided with a conventional seal if desired. As mentioned, the ring 15 for the adjustment of all the movable sections 3 in unison, is connected to the housing concentrically to the longitudinal axis of the engine.

Figure 3:
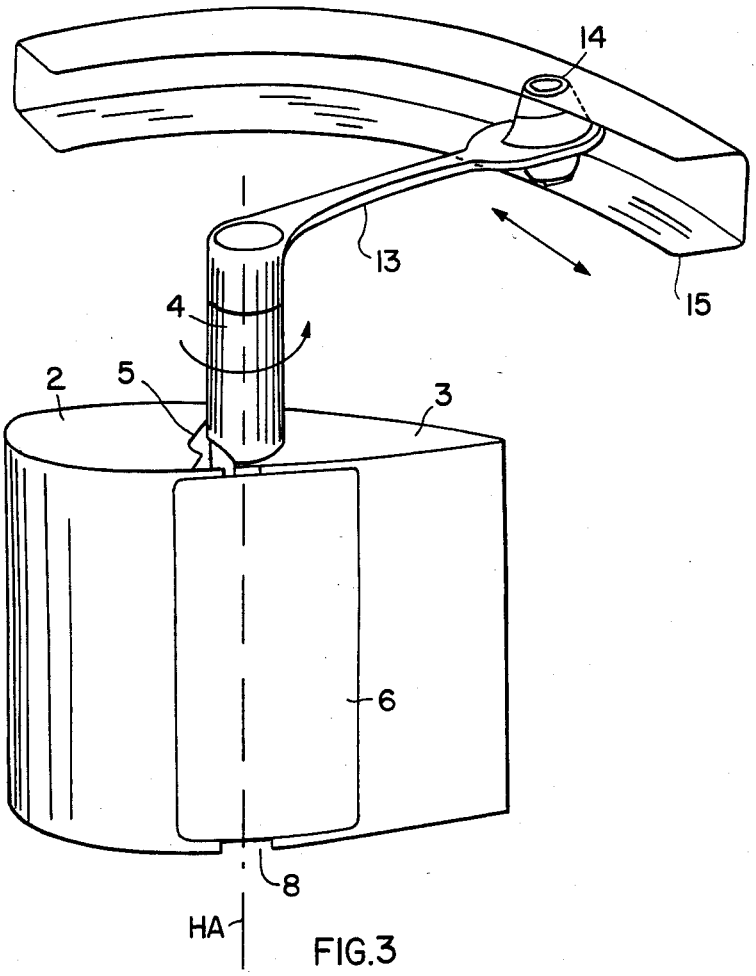
FIG. 3 is a perspective view of a single guide vane and part of a guide vane adjustment ring.

The perspective view of FIG. 3 illustrates the axial extent of the flexible cover band 6 and the location of the hinging axis HA also shown in FIG. 1.

Figure 4:
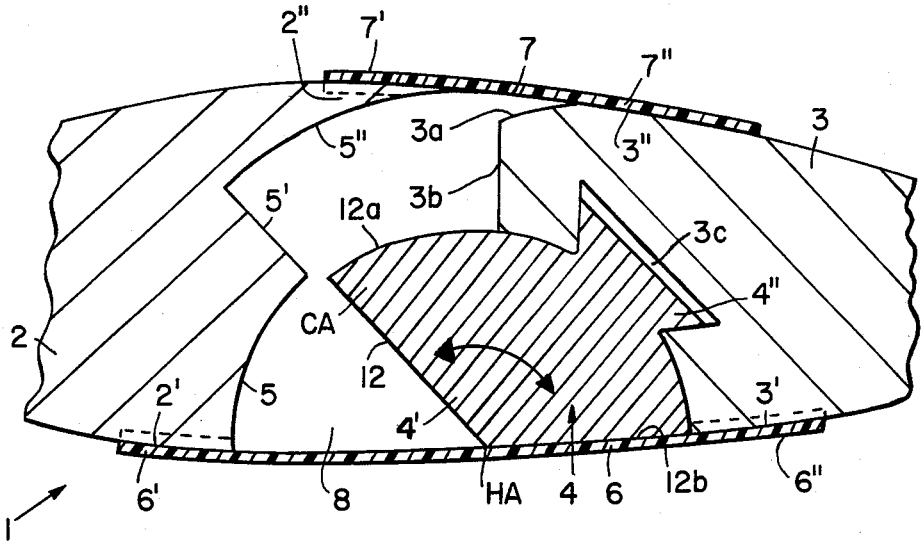
FIG. 4 is an enlarged view of a portion of FIG. 1, to illustrate in somewhat more detail, the position of the elastic covering tape and of the yielding covering band according to the invention.
Figure 5:
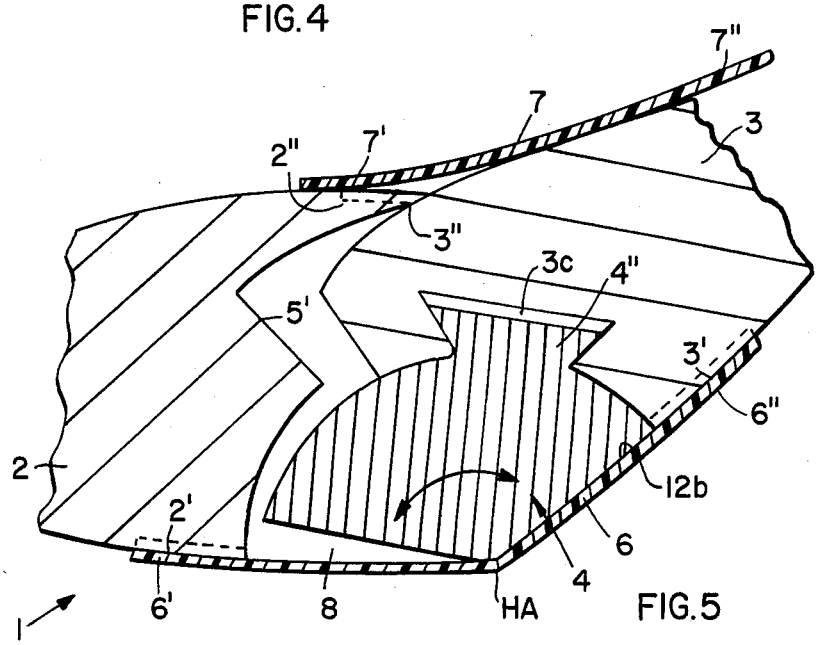
FIG. 5 is a view similar to that of FIG. 4, but showing the guide vane outlet section deflected relative to the stationary inlet section.

FIGS. 4 and 5 are views as in FIG. 1, but on an enlarged scale to show further details. The gap 8 is bounded by a contoured surface of the stationary vane section 2 and by contoured surfaces of the movable vane section 3 and of the position adjustment member 4. The contoured surface of the stationary vane section 2 comprises a surface portion 5 having a curvature corresponding to the curvature of the surface portion 12*a* of the position adjustment member 4 to such an extent that the surface portions 5 and 12*a* can extend in parallel to each other when the movable vane section 3 is tilted upwardly by rotating the position adjustment member 4 in the counterclockwise direction. The surface portion 5' cooperates with the surface portion 3*b*, thereby providing a stop or limit for the maximum upward tilting of the movable vane section 3. The surface portion 5'' has a curvature different from that of the surface portion 5 so that there will be no interference with the tilting movement of the movable vane section 3. The surface portion 3*a* has a curvature so as to facilitate the sliding movement of the cover band 7 relative to the vane section surface 3''.

Dashed lines below the elastic tape 7 and above the cover tape 6 indicate that these cover members may be recessed into the respective vane sections 2 and 3 to assure an aerodynamically efficient surface of the vane sections.

FIG. 4 further shows that the position adjustment member 4 for the movable vane section 3 has a sector portion 4' and a dovetail portion 4''. The movable vane section 3 has a dovetail groove 3*c* in which the dovetail portion 4'' is received with a friction fit or form-locking manner so that the connection between the movable vane section 3 and the adjustment member 4 is the only mounting for the movable vane section 3. However, the invention is not limited to this type of connection between the movable vane section 3 and the adjustment member 4. The adjustment member 4 further has a surface portion 12*b* which is permanently secured to the flexible cover band 6, for example, by an adhesive bonding which may be accomplished by the curing of the resin in the flexible cover band 6 if the latter is made of a fiber reinforced composite material. The similar bonding may be accomplished between the edges 6', 6'' and the vane rims 2' and 3'. Similarly, the edge 7' of the cover tape 7 is adhesively bonded to the rim 2''. The edge 7'' rests in a sliding manner on the rim portion 3''. In FIG. 5 the movable vane section 3 is shown in a deflected position relative to the position shown in FIG. 1 to illustrate the disposition of the flexible band 6 and of the elastic tape 7 when the movable vane section is in said deflected position.

Although the invention has been described with reference to specific example embodiments, it will be appreciated, that it is intended to cover all modifications and equivalents within the scope of the appended claims.

What I claim is:

1. A guide vane having a flow dynamic cross-section with a compression side and a suction side for turbo-engines, especially gas turbines, comprising a stationary vane section (2) and a movable vane section (3), adjustment means for adjusting the position of said movable vane section relative to the stationary vane section, a gap between said stationary vane section and said movable vane section, said gap extending through said vane from said compression side to said suction side, first flexible cover means covering said gap on one side of said guide vane, and second yielding elastic cover means covering said gap on the other side on said guide vane, said first and second covering means permitting movement of said position adjustable vane section relative to said stationary vane section, wherein said first flexible cover means comprise a flexible band (6) having longitudinal edges permanently secured to said stationary vane section and to said position adjustable vane section, and wherein said second cover means comprise an elastic tape (7) having a first longitudinal rim permanently secured to said stationary vane section and a second longitudinal rim movably overlapping said position adjustable vane section, and wherein said position adjustment means have a rotational axis coinciding with an outer contour of said guide vane for rotating said movable vane section (2) relative to said stationary vane section (3).

2. The guide vane of claim 1, further comprising means for permanently attaching said flexible band (6) to said position adjustment means.

3. The guide vane of claim 2, wherein said attaching means comprise an adhesive bond between said flexible band (6) and said stationary and movable vane sections nd between said flexible band (6) and said position adjustment means.

4. The guide vane of claim 2, wherein said attaching means comprise a welding for securing said flexible band (6) to said stationary and movable vane sections and to said position adjustment means.

5. The guide vane of claim 2, wherein said flexible band (6) is bonded to said stationary and movable vane sections and to said position adjustment means by curing said flexible band (6).

6. The guide vane of claim 1, further comprising connection means for connecting said position adjustment means to said movable vane section by a form-locking connection.

7. The guide vane of claim 1, further comprising connection means for connecting said position adjustment means to said movable vane section by a friction fit connection.

8. The guide vane of claim 1, wherein said guide vane has a central axis in a zone where said guide vane has its largest thickness, said guide vane further comprising means connecting said position adjustment means to said movable vane section at an asymmetric location relative to said central axis of said guide vane, and wherein said rotational axis of said position adjustment means extends in parallel to said central axis.

9. The guide vane of claim 8, wherein said position adjustment means have a sector portion with a sector cross-sectional shape and a dovetail portion with a dovetail cross-sectional shape, said connecting means comprising a dovetail groove in said movable vane section, said dovetail portion of said position adjustment means being received in said dovetail groove to form a dovetail joint, said sector portion having a center coinciding with said rotational axis of said position adjustment means, said sector portion further having an outwardly facing side coinciding with said outer contour of said guide vane, said flexible band (6) being permanently secured to said outwardly facing side of said sector portion.

10. The guide vane of claim 1, wherein said gap between the stationary vane section and said movable vane section is located approximately at the largest thickness of said guide vane.

11. The guide vane of claim 1, wherein said flexible band (6) is made of a fiber reinforced composite material.

12. The guide vane of claim 1, wherein said elastic tape (7) is made of fluorocarbon polymers.

13. The guide vane apparatus of claim 1, further comprising mounting means for securing said movable vane section only at its radially outer end to an outer housing ring so that a radially inner end of said movable vane section is free.

* * * * *